US006092625A

United States Patent [19]

Bedrosian

[11] Patent Number: 6,092,625

[45] Date of Patent: Jul. 25, 2000

[54] ANTI-SLIP LADDER PAD

[76] Inventor: Richard Bedrosian, 30 Adams Rd., Hubbardston, Mass. 01452

[21] Appl. No.: 08/886,320

[22] Filed: Jul. 1, 1997

[51] Int. Cl.[7] ..... E04G 5/02

[52] U.S. Cl. ..... 182/107; 182/214; 248/210

[58] Field of Search ..... 182/107, 108, 182/109, 206, 214; 16/42 R, 42 T; 248/210

[56] References Cited

U.S. PATENT DOCUMENTS

| | | | |
|---|---|---|---|
| 513,920 | 1/1894 | Guste . | |
| 1,179,391 | 4/1916 | Bachman | 182/108 X |
| 2,448,350 | 8/1948 | Brown | 228/61 |
| 2,680,554 | 6/1954 | Dakin | 228/60 |
| 3,828,889 | 8/1974 | Rehm | 182/107 |
| 4,175,641 | 11/1979 | Reyes | 182/108 X |
| 4,339,020 | 7/1982 | Wiseman | 182/214 |
| 4,359,138 | 11/1982 | Kummerlin et al. | 182/107 X |
| 4,444,291 | 4/1984 | McPherson | 182/214 |
| 4,580,660 | 4/1986 | Oling | 182/107 |
| 4,723,629 | 2/1988 | Vanden Hoek et al. | 182/107 |
| 4,754,842 | 7/1988 | Southern | 182/111 |
| 4,823,912 | 4/1989 | Gould et al. | 182/107 X |
| 5,165,501 | 11/1992 | Donahey | 182/107 X |
| 5,180,032 | 1/1993 | Hidalgo | 182/107 X |
| 5,293,958 | 3/1994 | Swiderski et al. | 182/214 |
| 5,509,500 | 4/1996 | Delagera | 182/107 |

*Primary Examiner*—Daniel P. Stodola
*Assistant Examiner*—Richard M. Smith
*Attorney, Agent, or Firm*—Nields, Lemack & Dingman

[57] ABSTRACT

A simple, self-contained, anti-slip ladder pad which can be readily clipped on to a ladder anywhere along the length of the ladder rails without using screws or bolts to adjust the position of the ladder pad or to secure the ladder pad in place.

4 Claims, 5 Drawing Sheets

ANTI-SLIP LADDER PAD

FIELD OF THE INVENTION

This invention relates to a simplified ladder pad capable of being readily mounted on a ladder, to prevent the ladder from slipping and to protect the object against which the ladder is placed from damage caused by the ladder, without the need for tedious screws or bolts to fix the ladder pad in place.

BACKGROUND OF THE INVENTION

Ladder pads and similar devices are well known in the art to prevent ladders from slipping off objects against which ladders are placed and to protect those objects from damage caused by resting the ladder against the object. There are many variations on devices used to fix ladders in place against a building and devices used to prevent direct contact between ladders and the building. However, these devices are fairly complex in that they comprise numerous parts, thus making the devices expensive to manufacture and assemble. Furthermore, these devices utilize tedious fastening means including multiple set screws, pins, bolts, and lugs, which require additional tools and a substantial amount of time, effort and patience to mount the pad on a ladder. Oftentimes, such devices cannot be mounted while the ladder is lying on the ground, but must be attached to a gutter first, making attachment awkward, dangerous, and rather pointless since a ladder must be used, and pressed against the gutter, in the first place to initially mount the pad to the gutter. Most of these devices are also limited in their use because they either attach only to the upper ends of the ladder rails or require other external means such as a gutter or adaptations to the ladder itself to effect attachment or support.

SUMMARY OF INVENTION

Therefore it is an object of the invention to provide a ladder pad that is readily mounted to a ladder without the need for external tools.

It is a further object of the invention to provide a ladder pad which is self-contained, in that it does not require a gutter or a modified ladder for support or attachment.

It is a further object of the invention to provide a ladder pad which can be moved easily from one point to another point along the ladder rail.

It is a further object of the invention to provide a ladder pad which is inexpensive to manufacture and assemble.

It is a further object of the invention to provide a ladder pad which can be mounted to a ladder anywhere along the length of the ladder rails.

It is a further object of the invention to provide a ladder pad which can be mounted while the ladder is on the ground.

It is a further object of the invention to provide a ladder pad which can be used against many surfaces including gutters, roof shingles, drip edges, wood shingles, metal roofs and metal flashing.

This invention is the result of efforts to design a ladder pad which could be quickly and easily attached and reattached, and which is not limited to use at certain heights or angles, at certain positions on the ladder, or with specific types of surfaces. The ladder pad of this invention can be clipped to a ladder rail with a single motion simply by depressing the handle of a spring-loaded clamp attached to the ladder pad while sliding the ladder pad around the edge of a ladder rail and releasing the handle when the edges of the ladder rail are secured between a channel on the ladder pad.

This invention features an anti-slip ladder pad for use with a ladder having at least one ladder rail having a thickness comprising, a pad having a first and a second side; a channel provided on the first side of the pad, wherein the channel has a dimension slightly greater than the rail thickness; and a clamping means for removably securing the ladder pad to the ladder rail. The ladder pad can be removably attached to a ladder at various points along the ladder's length.

The clamping means may comprise a spring-loaded clamped secured or molded to the pad. The clamping means is preferably adapted to grip the ladder rail so that the ladder rail, when gripped, is positioned within the channel.

The preferred embodiment of the ladder pad may further comprise a plate having a first and second side, wherein the first side of the plate is secured to the first side of the pad, and wherein the channel is secured or molded to the second side of the plate. The plate and channel are preferably metal although other suitable materials may be used. The plate and channel may also be molded as a single unit. The clamping means may also be molded to the plate as a single unit.

Another preferred embodiment of a ladder pad, for use with a ladder with vertical rails, adapted to prevent the ladder from sliding and to protect the object against which the ladder is resting from damage caused by the ladder, comprises, a plate having a first and a second side; a plurality of channel walls provided on the first side of the plate so that the channel walls are substantially perpendicular to the first side of the plate; a pad attached to and substantially covering the second side of the plate; and a spring-loaded clamp attached to the first side of the plate. This embodiment is also can be removably attached to a ladder at various points along the ladder's length. The channel walls each may have a base portion attached to the first broadside of the plate and the spring-loaded clamp may comprise a handle portion and a clasp portion, wherein the clasp portion further comprises two opposable digits. One of the digits is preferably attached to the first broadside of the plate so that the handle portion extends outward from the ladder pad to facilitate handling and operation. The spring-loaded clamp is adapted to removably clasp a ladder rail between the clasp portion of the spring-loaded clamp so that the ladder rail, when clasped, is positioned between two or more channel walls.

Another preferred embodiment of the invention comprises a ladder pad for use with a ladder having at least one rail having a thickness comprising: a plurality of pads; a channel secured to at least one of the pads, wherein the channel has a dimension slightly greater than the rail thickness; and a clamping means for removably securing the ladder pad to the rail. The ladder pad of this embodiment may further comprise a plate having a first and second side, wherein the first side of the plate is secured to at least one of the pads, and wherein the channel is secured or molded to the second side of the plate.

The pad or pads may be flexible or rigid comprise a high density foam rubber or any other suitable material and may be permanently fixed to the plate by adhesive or other suitable means. The plate and channel of any embodiment may be made of metal, plastic, polyvinyl or fiberglass, and may be molded in one piece, separate from or together with the clamp or pad. The invention further contemplates a clamp which is adjustable for varying applications.

BRIEF DESCRIPTION OF THE DRAWINGS

Other objects, features and advantages will occur to those skilled in the art from the following description of a preferred embodiment and the accompanying drawings in which.

DETAILED DESCRIPTION OF THE INVENTION

The ladder pad of this invention is simple in design, inexpensive to make, and easy to use. Generally the ladder pad comprises a broad, thin plate on which a channel is separately or integrally fixed to the top side of the plate, and to which a durable padding material is fixed to the plate's underside side. A clamping means is also integral with or fixed to the top side of the plate so that a person can grip the handle portion of the clamp to attach or release the clamp to or from a ladder.

Figure 1:
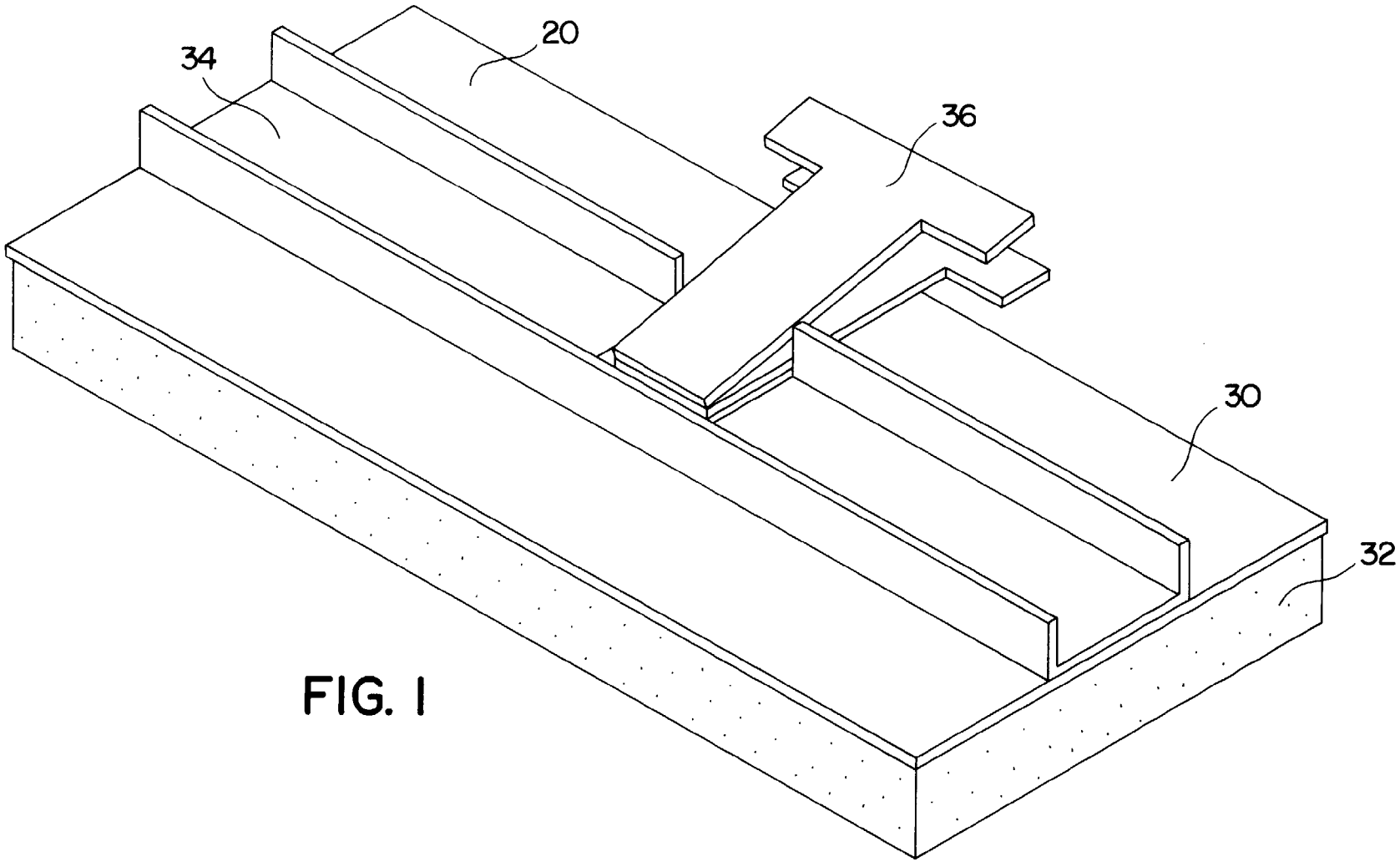
FIG. 1 is a perspective view of a preferred embodiment of the invention.

FIG. 1 illustrates a preferred embodiment of the invention. As shown in FIG. 1, ladder pad 20 comprises a thin plate 30, a durable pad 32, channel 34 and clamp 36. Plate 30 is preferably metal, although other suitable materials may be used including, but not limited to, plastic, polyvinyl or fiberglass. The choice of material and dimensions of the plate are limited only in that they must be of sufficient strength and size that, when combined, the material and dimensions together form a plate capable of withstanding substantial force exerted on its broadside. The ladder pad of this invention is not limited to the rectangular shape shown in FIG. 1. The shape and size will be determined by the circumstances in which the ladder pad is used.

Figure 2A:
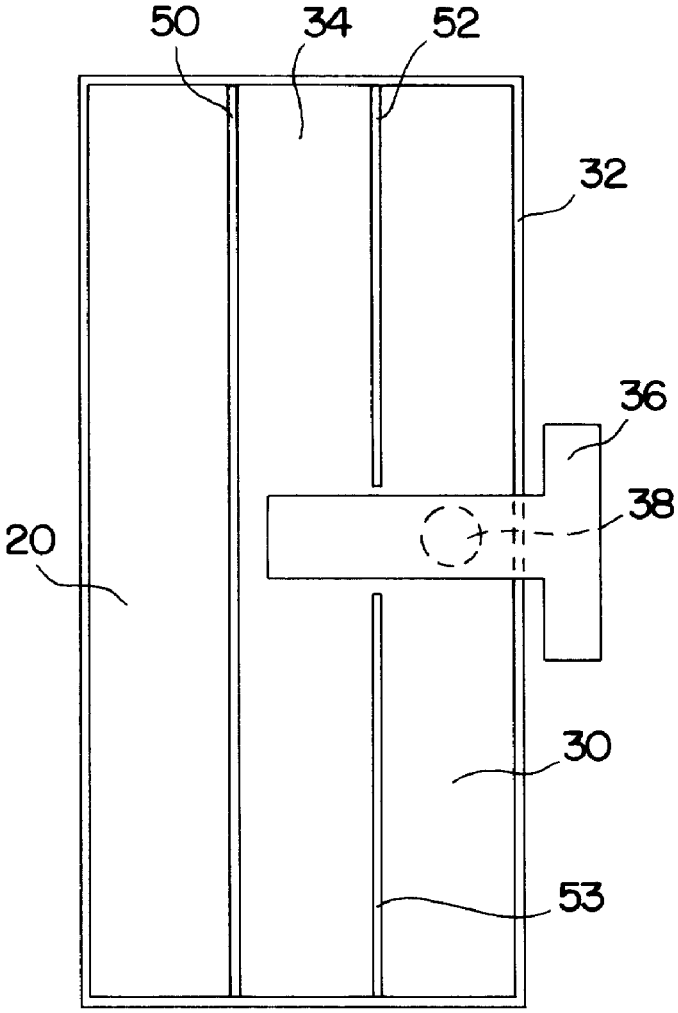
FIG. 2A is a top view of the embodiment shown in FIG. 1.
Figure 2B:
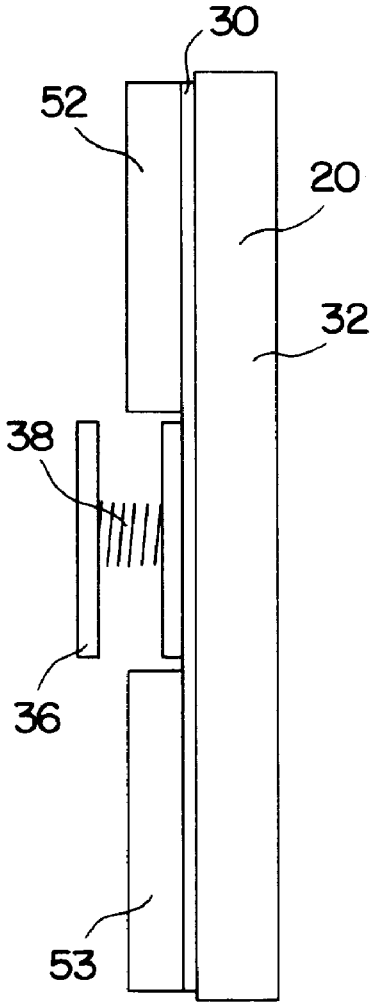
FIG. 2B is a lateral view of a second embodiment of the invention.
Figure 2C:
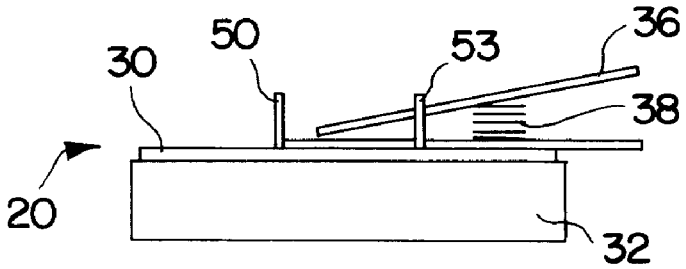
FIG. 2C is a lateral view of the embodiment shown in FIG. 1 of the embodiment's short side.

Pad 32 is preferably made from a high density foam rubber although other suitable materials may be used, including natural or vulcanized rubber. The material of the pad is limited only to an extent where the rigidity of the overall pad is sufficient to withstand considerable pressure and abrasion, without damaging the object's surface upon which the pad will rest. The preferred embodiment of pad 32 is about ¾" thick×9" long×4" wide and completely covers, and slightly extends beyond the edges of, plate 30, as shown in FIGS. 2A, 2B and 2C. However, these dimensions are not critical to the invention and may vary depending on the materials and the intended use of the ladder pad. Further, pad 32 is not limited to a solid piece of rubber but may comprise layers of suitably adapted material and/or smaller pads attached at appropriate areas on the underside of plate 30, as shown in FIG. 2C. Pad 32 may be attached to plate 30 by any appropriate means including, but not limited to, adhesives and/or screws. The invention contemplates embodiments which comprise only a pad without the need for a separate plate. In such embodiments, the pad material used should be sufficiently rigid to support substantial weight over a limited surface area without bending or abrading the surface of the object its intended to protect.

Channel 34 is preferably metal, but, similar to the plate, may comprise other materials such as plastic, polyvinyl or fiberglass. Channel 34 may be embodied in several forms. For example, channel 34 may consist of a solid trough as shown in FIG. 1 or as two or more walls fixed perpendicular to plate 30, with or without additional extensions. Channel 34, as a trough or as two separate walls fixed in the desired position to the broadside of plate 30, may be integrally molded to plate 30 and/or attached to plate 30 with screws or other similar means. The preferred embodiment of the channel, as shown in FIGS. 1, 2A, 2B and 2C, extends from one end of plate 30 to the opposite end of plate 30 and is about 1¼" wide between channel wall 50 and channel wall 52/53 to engage a typical ladder rail within the channel walls. The channel may be adapted to adjust to accommodate varying ladder rail widths.

In the preferred embodiment, channel wall 52/53 is not continuous along its length in order to form a gap through which clamp 36 is positioned. The height of channel walls 50 and 52/53 is preferably about ½". The channel of this invention is not limited to the dimensions or shape of the preferred embodiment and may vary depending on the intended use of the ladder pad.

In the preferred embodiment, clamp 36 is a heavy gauge spring-loaded clamp which is securely attached to pad 30 as shown in FIGS. 1, 2A, 2B and 2C. The clamp is positioned so that the front edge of the clamp is approximately equidistant from all edges of the plate for proper balance and weight distribution. The handle portion of the clamp should extend beyond the edge of the plate to facilitate handling and operation. Clamp 36 includes a clasping portion comprising at least two opposable digits to form the upper and lower jaws of the clamp. The clamp may be integrally molded to plate 30 or fixed with a screw or other similar means. In the preferred embodiment, clamp 36 is attached to plate 30 with two screws threaded through two bore holes provided in the lower jaw of clamp 36. This invention envisions applications where more than one clamp may be desired or where the clamp and/or channel are fixed in positions not shown in the illustrations provided.

Figure 3:
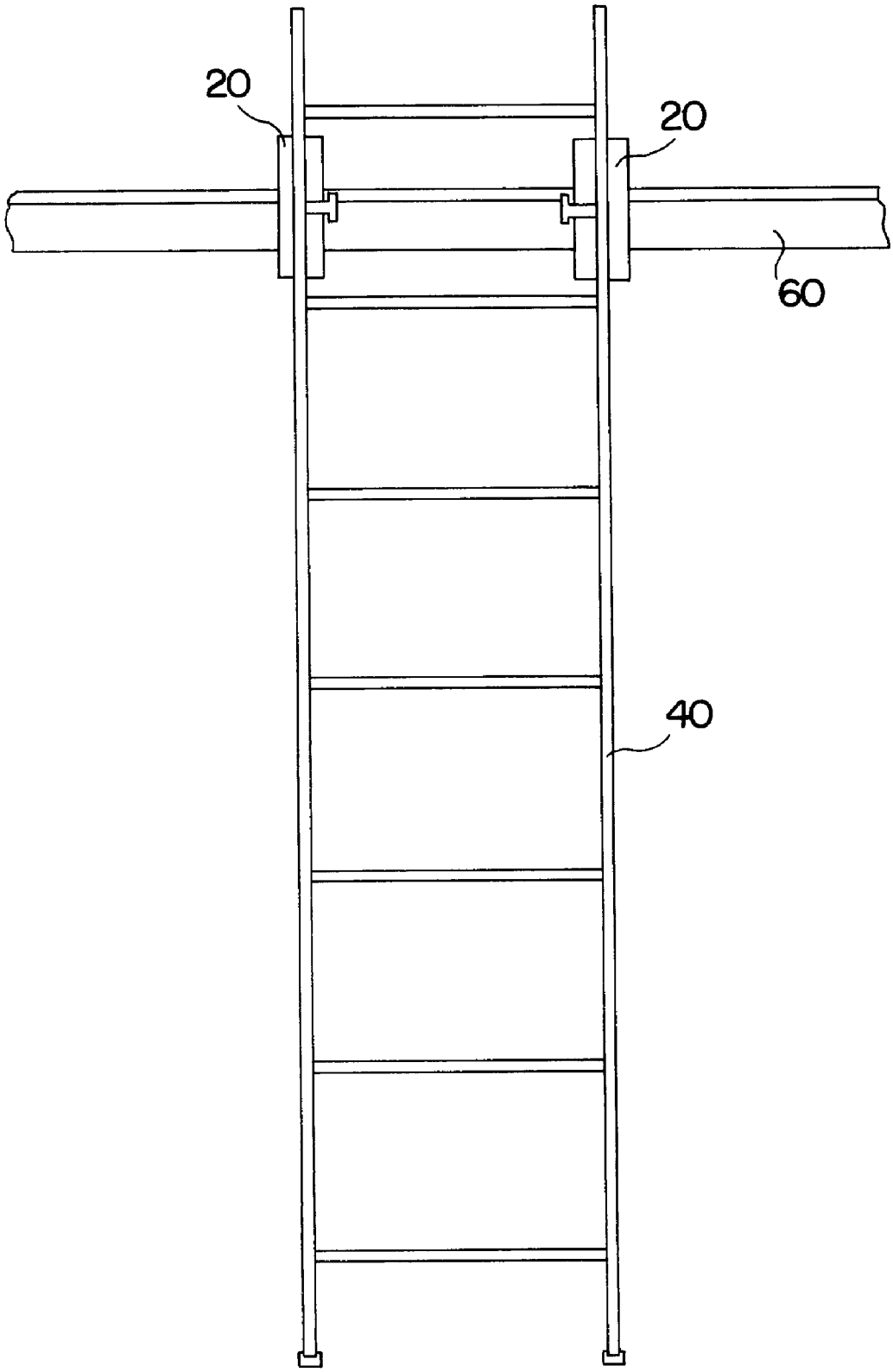
FIG. 3 is a frontal view of two identical embodiments of the invention mounted on a ladder resting against a surface.
Figure 4:
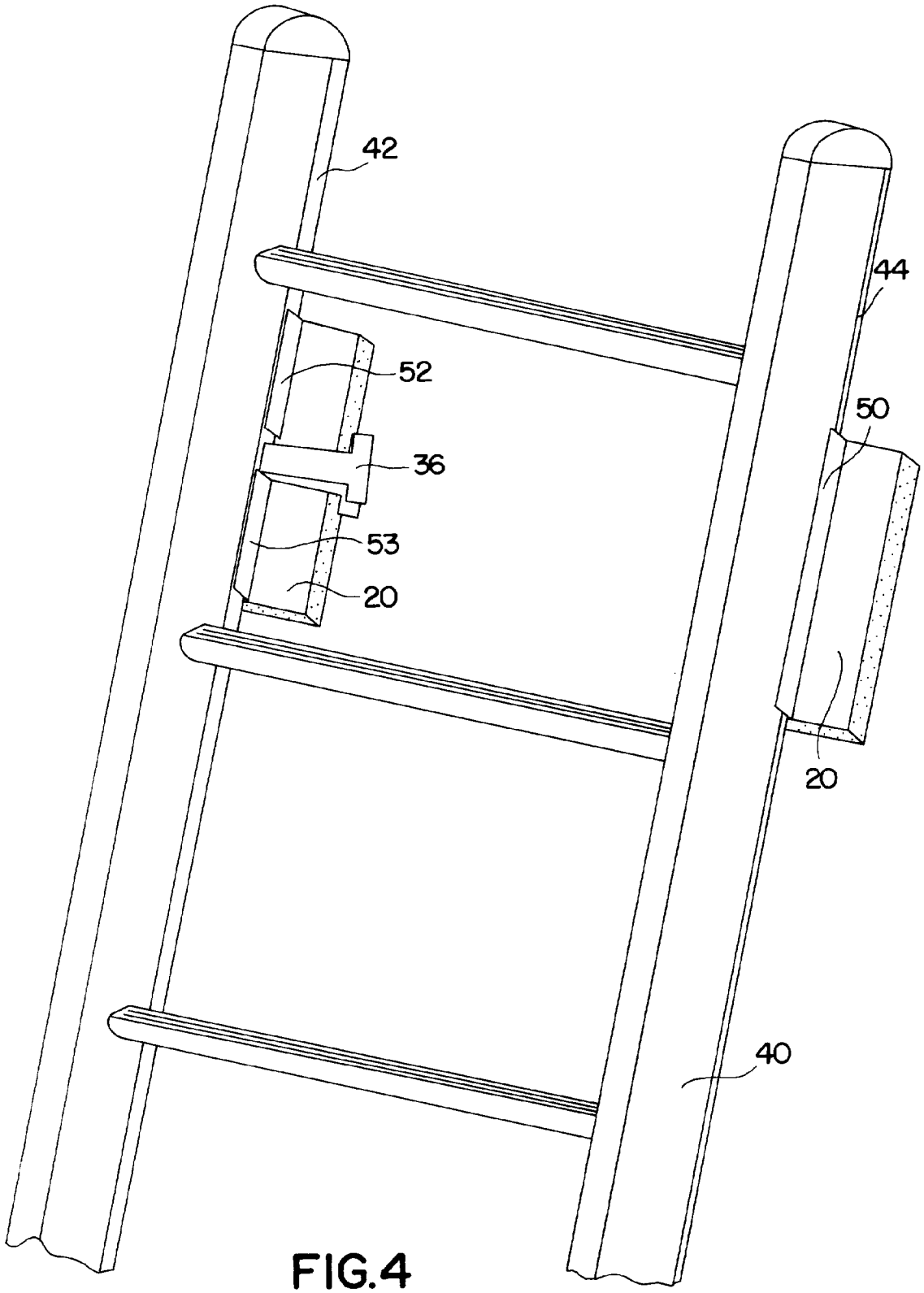
FIG. 4. is a perspective view of the two embodiments mounted as shown in FIG. 3.
Figure 5:
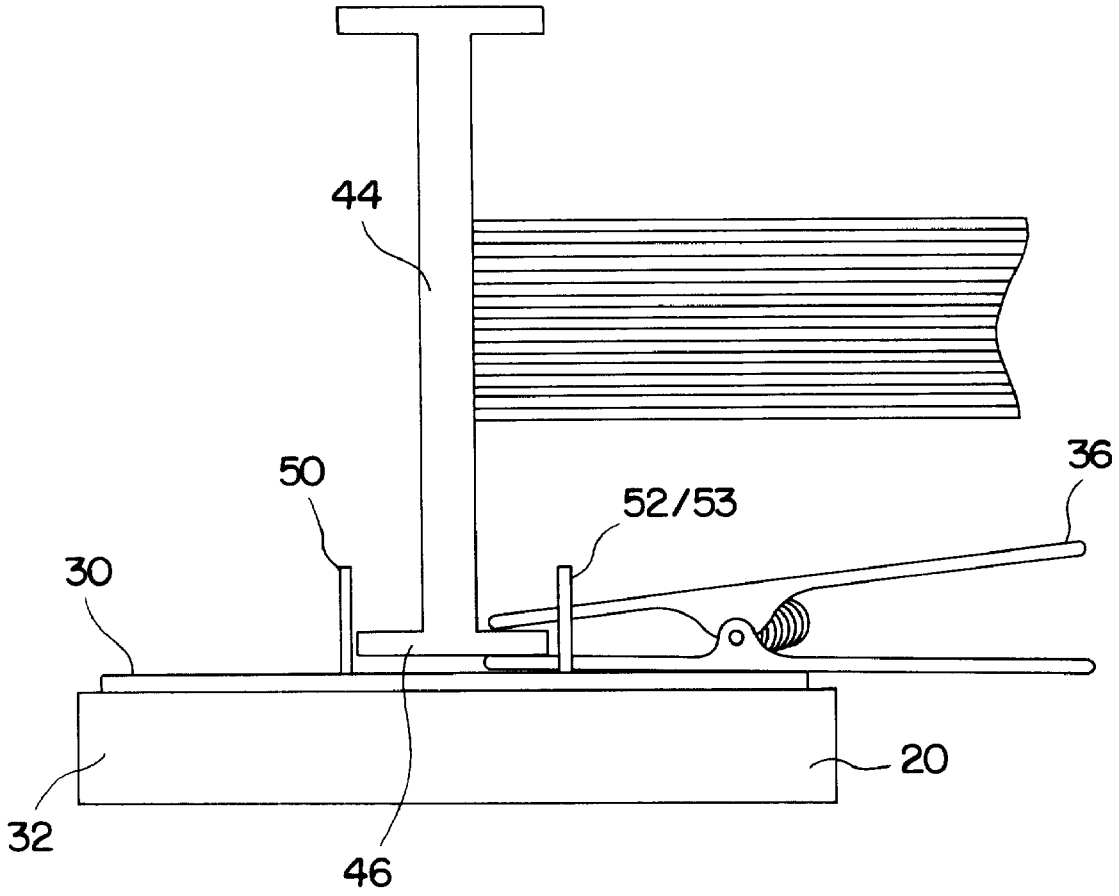
FIG. 5 is a lateral cross-sectional view of the embodiment shown in FIG. 4

FIGS. 3, 4 and 5 illustrate the manner in which the ladder pad is preferably used. FIG. 3 is a front view of a ladder resting against a gutter. Two ladder pads are shown clipped to the underside of each vertical ladder rail so that the pad of the ladder pad rests against the gutter or other building surface. To engage the ladder rail, the handles of clamp 36 are depressed or squeezed together to open the front jaws of clamp 36 to an extent sufficient to slide the edge of the ladder rail between the open jaws of clamp 36 while clearing the top edge of channel walls 50 and 52/53. The inside edge of ladder rail 44 is inserted between the open jaws of claim 36 so that both vertical edges of the ladder rail facing the building are secured within channel 34 between channel walls 50 and 52/53. Once the ladder pad is in the correct position, the handles of clamp 36 are released. FIG. 4 is a perspective view of the ladder and ladder pads shown in FIG. 3. FIG. 4 shows inner channel wall 52/53 of the left ladder pad engaging the inner side of ladder rail 42 and shows outer channel wall 50 of the right ladder pad engaging the outer side of ladder rail 44. The ladder pad of this invention may be clipped anywhere along the edge of a ladder rail.

FIG. 5 is a lateral cross-sectional view of the right ladder pad engaging ladder rail 44 shown in FIG. 4. Clamp 36 is shown gripping inner edge 46 of ladder rail 44 which is positioned so that inner edge 46 sits between channel walls 50 and 52/53. To reposition the ladder pad, simply squeeze handle 36 and slide the ladder pad out and reposition where desired. The ladder pad should be clipped to the ladder at the point where the ladder will rest against a surface. Any number of ladder pads may be used, at the same time, as needed.

What is claimed is:

1. A ladder pad, for use with a ladder having at least one ladder rail having a thickness and a length, adapted to prevent the ladder from sliding and to protect the object against which the ladder is resting from damage caused by the ladder, comprising, a plate having a first and a second side opposite said first side;

a plurality of channel walls provided on said first side of said plate so that said channel walls are substantially perpendicular to said first side of said plate, said channel walls defining therebetween a channel, said channel adapted to receive said ladder rail;

an anti-slip rubber pad attached to and substantially covering said second side of said plate; and a spring-loaded clamp attached to said first side of said plate and adapted to removably attach said plate to said rail when said rail is received by said channel anywhere along said length of said rail.

2. The ladder pad of claim 1, wherein said channel walls each have a base portion attached to said first side of said plate.

3. The ladder pad of claim 2, wherein said spring-loaded clamp comprises a handle portion and a clasp portion, said clasp portion further comprising two opposable digits wherein one of said digits is attached to said first side of said plate so that said handle portion extends outward from said ladder pad to facilitate handling and operation.

4. The ladder pad of claim 3, wherein said spring-loaded clamp is adapted to removably clasp said ladder rail between said digits of said spring-loaded clamp so that said ladder rail is positioned between two or more of said channel walls.

* * * * *